US007641764B2

(12) United States Patent
Yoshida et al.

(10) Patent No.: US 7,641,764 B2
(45) Date of Patent: Jan. 5, 2010

(54) NON-WOVEN FABRIC FOR GYPSUM BOARD AND PROCESS FOR PRODUCING THE SAME

(75) Inventors: Mitsuo Yoshida, Tokyo (JP); Kunihiro Tanabe, Tokyo (JP); Hitoshi Fujiki, Tokyo (JP)

(73) Assignee: Mitsubishi Paper Mills Limited, Tokyo (JP)

( * ) Notice: Subject to any disclaimer, the term of this patent is extended or adjusted under 35 U.S.C. 154(b) by 196 days.

(21) Appl. No.: 11/792,053

(22) PCT Filed: Dec. 2, 2005

(86) PCT No.: PCT/JP2005/022145

§ 371 (c)(1),
(2), (4) Date: Jun. 1, 2007

(87) PCT Pub. No.: WO2006/059699

PCT Pub. Date: Jun. 8, 2006

(65) Prior Publication Data

US 2007/0298235 A1 Dec. 27, 2007

(30) Foreign Application Priority Data

Dec. 3, 2004 (JP) ..... 2004-350663
Jan. 5, 2005 (JP) ..... 2005-000680
Mar. 25, 2005 (JP) ..... 2005-089798

(51) Int. Cl.
*D21H 27/18* (2006.01)
*D21H 13/40* (2006.01)
*D21H 13/10* (2006.01)
*D21H 13/16* (2006.01)
*D21H 13/22* (2006.01)
*E04C 2/26* (2006.01)

(52) U.S. Cl. ..... 162/125; 162/145; 162/146; 162/138; 162/181.4; 442/373; 442/412; 442/415; 428/294.7; 428/172

(58) Field of Classification Search ..... 162/141, 162/145–146, 149, 157.1, 157.4, 158, 181.1, 162/181.4, 123, 125, 129–130, 164.1, 168.3, 162/205, 138, 152, 156; 428/294.7, 299.1, 428/299.4, 299.7, 300.7, 703; 442/327, 331–332, 442/342, 373, 381, 412, 415
See application file for complete search history.

(56) References Cited

U.S. PATENT DOCUMENTS 2,971,877 A * 2/1961 Arledter ..... 162/101
4,234,379 A * 11/1980 Conway et al. ..... 162/145
5,294,299 A * 3/1994 Zeuner et al. ..... 162/145
5,437,767 A * 8/1995 Halout et al. ..... 162/145
5,709,925 A * 1/1998 Spengler et al. ..... 428/198
5,883,024 A * 3/1999 O'Haver-Smith et al. ... 442/333
6,001,496 A * 12/1999 O'Haver-Smith ..... 428/703
6,187,697 B1 * 2/2001 Jaffee et al. ..... 442/149
6,773,793 B2 * 8/2004 Flynn et al. ..... 428/221
6,883,575 B2 * 4/2005 Jaffee ..... 156/495
6,884,321 B2 * 4/2005 Erb et al. ..... 162/145
6,977,111 B2 * 12/2005 Yamaguchi et al. ..... 556/1
7,416,636 B2 * 8/2008 Blomqvist et al. ..... 162/101
2002/0153110 A1 * 10/2002 Yamaguchi et al. ..... 162/123
2003/0099833 A1 * 5/2003 Erb et al. ..... 428/404
2003/0113526 A1 * 6/2003 Jaffee ..... 428/297.4
2003/0232182 A1 * 12/2003 Bruce et al. ..... 428/292.4
2006/0068186 A1 * 3/2006 Leclercq et al. ..... 428/294.7
2007/0298235 A1 * 12/2007 Yoshida et al. ..... 428/294.7
2009/0124151 A1 * 5/2009 Shoemake ..... 442/180
2009/0163097 A1 * 6/2009 Kajander ..... 442/118

FOREIGN PATENT DOCUMENTS

JP 60246900 A * 12/1985
JP 62-111000 A 5/1987
JP 63120199 A * 5/1988
JP 63-275797 A 11/1988
JP 05086567 A * 4/1993
JP 07214933 A * 8/1995
JP 9-310284 A 12/1997
JP 10180020 A * 7/1998

(Continued)

OTHER PUBLICATIONS

Derwent Abstract of JP 62111000, published on May 22, 1987.*

(Continued)

*Primary Examiner*—José A Fortuna
(74) *Attorney, Agent, or Firm*—Birch, Stewart, Kolasch & Birch, LLP

(57) ABSTRACT

The object of the present invention is to provide a non-woven fabric comprising a glass fiber which has a strength, flexibility and water resistance, has less skin irritancy and a good surface decoration property, and a process for producing the same, more specifically, to provide a non-woven fabric for a gypsum board which is used as a reinforcing material for a gypsum board placed on one side or both sides of the gypsum board, and a process for producing the same. A non-woven fabric for a gypsum board comprising 20 to 60% by weight of a glass fiber, 10 to 50% by weight of an organic fiber and 10 to 50% by weight of a fibrous binder, which contains the organic fiber at least on a gypsum core contact surface, is provided.

17 Claims, No Drawings

FOREIGN PATENT DOCUMENTS

| | | | | |
|---|---|---|---|---|
| JP | 2000-045450 | A | | 2/2000 |
| JP | 2000-280433 | A | | 10/2000 |
| JP | 2001-020165 | A | | 1/2001 |
| JP | 2008086953 | A | * | 4/2008 |
| WO | WO 2006059699 | A1 | * | 6/2006 |

OTHER PUBLICATIONS

Derwent Abstract of JP 63-275797, published on Nov. 14, 1988.*

JPO Machine Translation of JP-2000-045450 A, published Feb. 15, 2000.*

JPO Machine Translation of JP-2000-280433 A, published Oct. 10, 2000.*

JPO Machine Translation of JP-09-310284 A, published on Dec. 2, 1997.*

* cited by examiner

NON-WOVEN FABRIC FOR GYPSUM BOARD AND PROCESS FOR PRODUCING THE SAME

TECHNICAL FIELD

The present invention relates to a non-woven fabric containing a glass fiber which is used for building materials and used during the production of the building materials, and a process for producing the same, and more specifically, relates to a non-woven fabric for a gypsum board which is used as a reinforcing material for a gypsum board, and a process for producing the same.

BACKGROUND ART

As a building material excellent in fire-safety, fire-resistance, sound insulation property, heat insulation property, constructability, strength, workability, decoration property and degradation-inhibiting property, a gypsum board has been widely used. In the gypsum board, a reinforcing material for the gypsum board is provided on one side or both sides of a core material mainly comprising gypsum, and the reinforcing material compensates for the weakness of the gypsum. A paper substrate has been generally used as the reinforcing material, and with the objective of further improving the above-mentioned properties, a non-woven fabric mainly comprising a glass fiber has been used (Patent literatures 1 and 2).

For a non-woven fabric used on both sides of a gypsum board as a reinforcing material, a certain extent of flexibility is required. If the flexibility of the non-woven fabric is poor, a crack may arise in the non-woven fabric during the manufacture of a gypsum board, and in some very extreme case, the non-woven fabric may be broken. The crack of the non-woven fabric leads to exudation of a gypsum slurry during the manufacture and to contamination around equipment such as a conveyer which transports the non-woven fabric, which causes problems of not only lowering the productivity but also reducing the strength of the gypsum board.

A non-woven fabric containing a glass fiber is excellent in strength and dimensional stability, and it has been conventionally used for the base material of a wallpaper or a floor material as a building material in addition to a gypsum board. However, when the content of the glass fiber is increased in order to improve strength and dimensional stability, the amount of the glass fiber to be exposed on the surface is increased, and the worker may feel irritation on his/her skin when handling it, which may become a problem.

On the other hand, for a building board material used for an interior material or an exterior material, including a gypsum board, it is an important requirement to have properties such as being lightweight, being a high strength, being smooth in surface and easy to be decorated with such as painting and wallpaper-pasting. A material the strength property of which is improved by reinforcement with a fiber, such as a fiber reinforcing-gypsum board which heretofore has been known, is a material in which a gypsum board is reinforced by a fibrous material. Thus, the strength property and workability are excellent; however, the material has a configuration in which a base material is exposed to the surface thereof, so that pretreatment such as sealer treatment is required to apply a surface decoration such as painting finish and wallpaper finish. Accordingly, a labor charge is generated on the painting work and this becomes a factor causing an increase in cost for the entire finish work. Moreover, a volatile component which affects the human body is contained in the sealer and the component diffuses during the painting work, so that the use thereof is tend to be limited. Also, for an interior material in which the decoration workability has a priority, a gypsum board coated with a paper board to which painting and wallpaper pasting are easily applied (a base paper for a gypsum board) has been widely used. However, the base paper for a gypsum board has a poor water resistance. When the base paper absorbs moisture, there are problems that peeling occurs between the layers of the base paper, etc.

[Patent literature 1] Japanese examined patent publication No. Hei 7-914

[Patent literature 2] Japanese unexamined patent publication No. 2002-285677

DISCLOSURE OF THE INVENTION

Problems to be Solved by the Invention

The object of the present invention is to provide a non-woven fabric comprising a glass fiber which has a strength, flexibility and water resistance, has less skin irritancy and has a good surface decoration property, and a process for producing the same, more specifically, a non-woven fabric for a gypsum board which is used as a reinforcing material for a gypsum board positioned at one side or both sides of the gypsum board, and a process for producing the same.

Means to Solve the Problems

The present inventors have earnestly studied to solve the above-mentioned problems, and as a result, they have found the following:

(1) A non-woven fabric for a gypsum board comprising 20 to 60% by weight of a glass fiber, 10 to 50% by weight of an organic fiber and 10 to 50% by weight of a fibrous binder, which contains the organic fiber at least on a gypsum core contact surface.

(2) The non-woven fabric for a gypsum board according to the above (1), wherein the folding endurance specified in JIS P8115 is 1.00 or more.

(3) The non-woven fabric for a gypsum board according to the above (1), wherein the organic fiber is a synthetic fiber.

(4) The non-woven fabric for a gypsum board according to the above (1), wherein a part of or whole of the fibrous binder is a polyvinyl alcohol fiber.

(5) The non-woven fabric for a gypsum board according to the above (1), which has a multilayer structure.

(6) The non-woven fabric for a gypsum board according to the above (4), wherein the weight of the polyvinyl alcohol fiber per unit weight of a gypsum core non-contact surface is more than 1 and is 15 or less if the weight of the polyvinyl alcohol fiber per unit weight of a gypsum core contact surface is defined as 1.

(7) The non-woven fabric for a gypsum board according to the above (1), which comprises a synthetic resin type binder provided in an amount of 1 to 60 parts by weight based on 100 parts by weight of the non-woven fabric.

(8) The non-woven fabric for a gypsum board according to (1), which comprises a water repellent agent provided at least on a gypsum core non-contact surface of the non-woven fabric in an amount of 0.1 to 5.0 parts by weight based on 100 parts by weight of the non-woven fabric.

(9) The non-woven fabric for a gypsum board according to the above (1), which comprises a synthetic resin type binder provided in an amount of 1 to 60 parts by weight and comprises a water repellent agent provided in an amount of 0.1 to 5.0 parts by weight, based on 100 parts by weight of the non-woven fabric.

(10) The non-woven fabric for a gypsum board according to the above (1), which comprises an ink-receptive layer provided on a gypsum core non-contact surface of the non-woven fabric.

(11) The non-woven fabric for a gypsum board according to the above (1), which comprises an adsorbing agent with BET specific surface area of 1 $m^2/g$ or more provided on the non-woven fabric.

(12) The non-woven fabric for a gypsum board according to the above (11), wherein the adsorbing agent is at least one selected from the group of aluminum hydroxide, magnesium hydroxide and zeolite.

(13) The non-woven fabric for a gypsum board according to the above (1), which comprises titanium oxide provided on the non-woven fabric.

(14) The non-woven fabric for a gypsum board according to the above (1), which comprises a conductive fiber or a conductive particle provided on the non-woven fabric.

(15) The non-woven fabric for a gypsum board according to the above (14), wherein the conductive fiber is a metal fiber or a carbon fiber.

(16) A process for producing a non-woven fabric for a gypsum board, which comprises a step of forming a fiber web comprising 20 to 60% by weight of a glass fiber, 10 to 50% by weight of an organic fiber and 10 to 50% by weight of a fibrous binder by a wet papermaking method, and then, drying the fiber web while attaching the same to Yankee dryer with pressure.

(17) The process for producing a non-woven fabric for a gypsum board according to the above (16), which comprises a step of providing a synthetic resin type binder to the non-woven fabric obtained by the wet papermaking method.

(18) The process for producing a non-woven fabric for a gypsum board according to the above (16), which comprises a step of providing a water repellent agent to the non-woven fabric obtained by the wet papermaking method.

BEST MODE FOR CARRYING OUT THE INVENTION

In the following, the present invention will be explained in detail. The non-woven fabric for a gypsum board of the present invention comprises a glass fiber, a fibrous binder and an organic fiber.

A glass fiber related to the present invention is not specifically limited, and there may be used various kinds of glass such as E-glass, C-glass, an alkali-resistant glass and high strength T-glass. Also, a fiber diameter and a fiber length of the glass fiber are not specifically limited, and the fiber diameter is preferably 5 to 25 μm and the fiber length is preferably 6 to 30 mm. When the fiber diameter is less than 5 μm, a non-woven fabric excellent in the formation can be prepared; however, the strength thereof may be lowered. When the fiber diameter exceeds 25 μm, the dimensional stability is increased; however, a void formed in fibers in the non-woven fabric becomes larger, and in some cases, gypsum may be exuded during the manufacture of the gypsum board depending on the manufacture condition. Moreover, there is also the problem that the glass fiber with the fiber diameter of more than 25 μm has skin irritancy. With respect to the fiber length, when the fiber length is less than 6 mm, the strength of the non-woven fabric may be decreased, and when the fiber length exceeds 30 mm, the formation may become poor. In the present invention, of these, E-glass is preferably used, and E-glass with the fiber diameter of 9 to 20 μm and the fiber length of 6 to 25 mm is particularly preferably used.

As an organic fiber related to the present invention, there may be mentioned a natural fiber, a regenerated fiber, a semi-synthetic fiber, a synthetic fiber and the like. The organic fiber has the property that it does not exhibit a thermal adhesiveness by heating to 50 to 200° C. with an air dryer or a Yankee dryer. The natural fiber may include wood pulp having less film forming ability, hemp pulp, cotton linter, and lint. The regenerated fiber may include lyocell fiber, rayon and cupra. The semi-synthetic fiber may include acetate, triacetate and promix. The synthetic fiber may include fibers such as a polyolefin type fiber, a polyamide type fiber, a polyacrylic type fiber, vinylon type fiber, vinyliden, polyvinyl chloride, polyester type fiber, nylon type fiber, urethane type fiber, benzoate, polycral, phenol type fiber and the like. Also, there may be contained a fiber having irregular cross-sectional shape such as T shape, Y shape and triangular shape in addition to a fiber having round cross-sectional shape, or a fiber subject to crimping. When the non-woven fabric for a gypsum board of the present invention is used for a gypsum board, the synthetic fiber is preferably used because it is necessary to increase the water resistance of the gypsum board in order to prevent a dimensional change and strength reduction due to moisture absorption of the gypsum board. In the present invention, of these, polyester fiber, polyacrylic type fiber, polyolefin type fiber and polyamide type fiber are preferably used, and polyester fiber is particularly preferably used. The fiber diameter of the organic fiber is not particularly limited, and it is preferably 3 to 30 μm, more preferably 7 to 20 μm. When the fiber diameter is less than 3 μm, the non-woven fabric becomes too tight so that striking-through of gypsum may become difficult. On the other hand, when the fiber diameter of the organic fiber exceeds 30 μm, the fiber is thick and rigid so that entanglement between the organic fiber and a glass fiber is weak during the wet papermaking, whereby attachment to a felt for papermaking or interlayer peeling may occur. The fiber length of the organic fiber is preferably 3 to 20 mm, more preferably 5 to 10 mm. When the fiber length is less than 3 mm, the entanglement with a glass fiber is weak whereby it has less effect of increasing the strength of the non-woven fabric. When the fiber length exceeds 20 mm, fiber dispersion is difficult to be uniform and the formation of the non-woven fabric may become poor.

As the fibrous binder of the present invention, there may be used a fiber which exhibits thermal adhesiveness by heating to 50 to 200° C. with an air dryer or Yankee dryer, etc., and increases the strength of a sheet. The fibrous binder related to the present invention may include monofilaments such as polyvinyl alcohol type fiber (hereinafter abbreviated as PVA fiber), viscose fiber, polyester fiber, polypropylene fiber and polyethylene fiber, or composite fibers having thermal adhesiveness such as core-in-sheath fiber (core shell type), parallel fiber (side by side type) and radial dividable-fiber. The composite fiber is difficult to form a film, so that it is effective in the case of increasing the mechanical strength while maintaining the voids inside the non-woven fabric. The composite fiber may include, for example, a combination of polypropylene (core) and polyethylene (sheath), a combination of polypropylene (core) and ethylenevinyl alcohol (sheath) and a combination of high melting point polyester (core) and low melting point polyester (sheath) and the like. Also, a monofilament consisting of a low melting point resin such as polyethylene fiber and polyester fiber (all melting type), or polyvinyl alcohol type fiber is easy to form a film during the drying of the non-woven fabric, so that a non-woven fabric having a smooth surface can be obtained. The fiber diameter of the fibrous binder is not particularly limited, and it is preferably 1 to 40 μm, more preferably 3 to 30 μm. The fiber length of the fibrous binder is preferably 1 to 20 mm, more preferably 2 to 15 mm. When the fiber length is less than 1 mm, entanglement with a glass fiber or an organic fiber during the wet papermaking may be weak and fibers may drop off. When the fiber length exceeds 20 mm, the fiber dispersion is difficult to be uniform and the formation of the non-woven fabric may become poor. In the present invention, of these, polyvinyl alcohol type fiber, and core-in-sheath fiber comprising low melting point polyester (sheath) and high melting point polyester (core) are preferably used in view of adhesiveness, more preferably polyvinyl alcohol type fiber excellent in surface smoothness.

When the glass fiber is contained in the non-woven fabric for a gypsum board, flexibility of the non-woven fabric becomes small since the rigidity of the glass fiber is large. When the flexibility of the non-woven fabric is insufficient, crack of the non-woven fabric may occur, or in some cases, the non-woven fabric may be broken in the folding step for specifying the width and the thickness of the gypsum board during the manufacture of the gypsum board. Once the crack of the non-woven fabric occurs, a gypsum slurry exudes to contaminate around equipments such as a conveyer which transports the non-woven fabric, which not only lowers the productivity but also causes the lowering of the strength of the gypsum board. The non-woven fabric for a gypsum board of the present invention contains 20 to 60% by weight of a glass fiber, as well as contains 10% by weight or more of an organic fiber and 10% by weight or more of a fibrous binder, wherein the combined amount of the organic fiber and the fibrous fiber is 40 to 80% by weight, so that the folding endurance specified in JIS P8115 is 1.00 or more. Thus, the non-woven fabric exhibits flexibility in spite of containing a glass fiber, so that it is possible to lessen the troubles in the folding step. The folding endurance is preferably 1.50 or more. In this case, the amount of the glass fiber is preferably 20 to 55% by weight, the amount of the organic fiber is preferably 10% by weight or more, the amount of the fibrous binder is preferably 10% by weight or more and the combined amount of the organic fiber and the fibrous binder is preferably 45 to 80% by weight. Even though a non-woven fabric in which the amount of a glass fiber to be contained is less than 20% by weight and the combined amount of an organic fiber and a fibrous binder to be contained is 80% by weight or more, has a folding endurance of 1.00 or more. When such a non-woven fabric is used as a non-woven fabric for a gypsum board, however, the problem is caused that the strength of the gypsum board is insufficient. Accordingly, it is more preferred that the content of the glass fiber is 20 to 60% by weight and the folding endurance is 1.00 or more.

The non-woven fabric for a gypsum board of the present invention can become a non-woven fabric having a uniform and smooth surface by preparing a fiber web containing a glass fiber, an organic fiber and a fibrous binder by wet papermaking, and then, drying the fiber web while attaching the same to Yankee dryer with pressure. As an index which represents a surface smoothness of the non-woven fabric for a gypsum board of the present invention, there is used a central surface average roughness (SRa) measured by a feeler system three dimensional surface roughness measuring instrument. The non-woven fabric for a gypsum board of the present invention contains a glass fiber. Thus, the value of the central surface average roughness SRa is high, which means that the rigid glass fiber protrudes from the surface of the non-woven fabric. To the contrary, the value of the central surface average roughness SRa is low, which means that the fibrous binder is sufficiently fused with pressure attachment using Yankee dryer, that the glass fiber is buried within the non-woven fabric with no glass fiber protruding from the surface of the non-woven fabric, and that the fibrous binder suitably fills the voids between the constituent fibers. The central surface average roughness SRa of the non-woven fabric for a gypsum board of the present invention is preferably less than 50 μm. When the SRa exceeds 50 μm, the decoration property such as painting or wallpaper pasting, or the property of printing on the gypsum board the identification information thereabout such as the logo of its manufacturing company and the trade name may become poor in the case where the non-woven fabric for a gypsum board of the present invention is used as a reinforcing material for a gypsum board. Moreover, skin irritancy becomes higher so that the handling property may become poor.

The fibrous binder is fused by heat to exhibit adhesiveness in the case of being heated by a dryer, etc., after papermaking. In the case of Yankee dryer, the suitable range of the dryer temperature is 100 to 160° C. The temperature of the fiber web contacted with the Yankee dryer in a wet paper state is considered to be 60 to 90° C., and the temperature of the fiber web in a dry state at the end stage of the drying step is 100 to 160° C. Accordingly, there may be used a fiber with the melting point of 60 to 160° C. as the fibrous binder.

As the fibrous binder, it is preferred to use a polyvinyl alcohol type fiber. An attachment mechanism of the non-woven fabric due to the polyvinyl alcohol type fiber is different from a mechanism due to the thermal adhesiveness as mentioned above. The polyvinyl alcohol type fiber maintains its fibrous shape hardly dissolved in water at room temperature, and it starts to dissolve easily by being heated with a dryer and the like after papermaking. When the polyvinyl alcohol type fiber is pressed by a pressing mechanism such as touch roll at the moment that it starts to dissolve, it becomes a binder across between main fibers, and then, it re-coagulates by dewartering and drying to become a fiber having a potent paper layer configuration which does not easily disaggregate if it is in hot water. Various effects of the polyvinyl alcohol type fiber on the adhesive force are considered, and as classified roughly, they may be considered in view of three points: the softening point in water, fiber diameter and fiber length.

The softening point in water means a temperature at which the fibrous binder starts to melt by heating a fiber web in a wet paper state with a dryer and exhibits an adhesive function. As the softening point in water, there is used a value described in a product catalog as a dissolution temperature in water of the polyvinyl alcohol fiber. The lower the softening point in water of the polyvinyl alcohol type fiber to be used, the easier the melting of the fibrous binder becomes and the higher the attachment effect becomes. However, in the case of a contact-drying type dryer such as a cylinder dryer, attachment to the dryer surface tends to occur. For melting the polyvinyl alcohol type fiber, the temperature of the fiber web in a wet paper state is needed to be higher than the softening point in water of the polyvinyl alcohol type fiber. Thus, the higher the drying temperature is, the bigger the attachment effect becomes, and then, the strength of the non-woven fabric is increased. When the temperature of the fiber web in a wet paper sate is less than the softening point in water of the polyvinyl alcohol type fiber, no melting of the fibrous binder may occur and no adhesive function may exhibit. The softening point in water is preferably 40 to 110° C., more preferably 60 to 95° C. For example, in the case of Yankee dryer, the temperature of the dryer is suitably in the range of 100 to 160° C. The temperature of the fiber web contacted with the Yankee dryer in a wet paper sate is considered to be 60 to 90° C. Thus, sufficient adhesive force can be obtained by selecting the polyvinyl alcohol type fiber with a softening point in water of 65 to 85° C.

As the fiber diameter of the fibrous binder becomes thinner, the strength of the resulting non-woven fabric is more increased. This is because, as the fibrous binder is added in the same weight ratio, the number of the fibers to be added is larger when fibers with thinner fiber diameter are used than that of when fibers with thicker fiber diameter are used, and the number of the adhesive point is increased. For the fiber length of the fibrous binder, dispersion of the fibers in slurry during the papermaking is more uniform when fibers with shorter fiber length are used than that of when fibers with longer fiber length are used, and as a result, the strength of the non-woven fabric is more increased.

The non-woven fabric for a gypsum board of the present invention comprises 20 to 60% by weight of a glass fiber, 10 to 50% by weight of an organic fiber and 10 to 50% by weight of a fibrous binder. When the content of the glass fiber is less than 20% by weight and the content of the organic fiber exceeds 50% by weight, the dimensional stability or the strength of the gypsum board is lowered. When the content of the glass fiber exceeds 60% by weight or the content of the organic fiber is less than 10% by weight, the folding endurance of the non-woven fabric becomes less than 1.00, as a result, the flexibility of the non-woven fabric is insufficient, and the crack of the non-woven fabric may occur during the manufacture of the gypsum board so that handling may become difficult. When the content of the fibrous binder is less than 10% by weight, it is insufficient to fill the voids on the surface of the non-woven fabric and the glass fiber protrudes from the non-woven fabric, so that the central surface average roughness SRa exceeds 50 μm, and the worker feels irritation on his/her skin during the handling of the non-woven fabric. Also, the strength of the non-woven fabric is lowered. When the content of the fibrous binder exceeds 50% by weight, the fibrous binder fused by heat excessively fills voids between the constituent fibers of the non-woven fabric, so that the air permeability of the non-woven fabric is lowered and gypsum is difficult to penetrate during the manufacture of the gypsum board, and thus, the productivity is lowered. In the present invention, it is preferred that the content of the glass fiber is 20 to 55% by weight, the content of the organic fiber is 10 to 45% by weight and the content of the fibrous binder is 10 to 45% by weight, more preferred that the content of the glass fiber is 25 to 50% by weight, the content of the organic fiber is 15 to 40% by weight and the content of the fibrous binder is 15 to 40% by weight. The weight of the non-woven fabric is preferably in the range of 50 to 300 g/m$^2$, more preferably in the range of 100 to 150 g/m$^2$. When the weight of the non-woven fabric is less than 50 g/m$^2$, the strength of the resulting gypsum board may be insufficient, and when it exceeds 300 g/m$^2$, the strength of the resulting gypsum board is excessive so that it is undesirable from an economical viewpoint.

The non-woven fabric for a gypsum board of the present invention may have a uniform density and fibrous constitution as a whole, and if the property required for the front side of the non-woven fabric is different from that of the back side of the same, by forming respective layers having different properties to prepare a non-woven fabric having a multilayer structure, the resulting non-woven fabric fulfills the requirements. When the non-woven fabric for a gypsum board of the present invention is used as a reinforcing material for a gypsum board, the surface contacted with the gypsum core (hereinafter referred to as a gypsum core contact surface) is required to have a property of adhering to gypsum or permeability of a gypsum slurry, and a surface of the non-woven fabric which constitutes the external surface of the gypsum board (a surface not contacted with the gypsum core, which is hereinafter referred to as a gypsum core non-contact surface) is required to have less skin irritancy and a decoration property. The non-woven fabric for a gypsum board of the present invention becomes a non-woven fabric which fulfills these requirements by increasing the content ratio of PVA fiber in the gypsum core non-contact surface than that of the gypsum core contact surface. To the non-woven fabric containing PVA fiber can be transferred a smooth surface of a dryer with pressure-drying (heating) using a contact type drying device such as Yankee dryer. For this reason, for the non-woven fabric for a gypsum board of the present invention, at a time that the fiber web in a wet paper state is dried by attaching the same to the surface of Yankee dryer with pressure after the manufacture of the wet papermaking, it is required that the surface contacted with the Yankee dryer surface is used as the external surface (the gypsum core non-contact surface). Also, since the transfer degree for the smoothness of the dryer surface is proportional to the formulation ratio of PVA fiber, the higher the content ratio of PVA fiber the smoother the gypsum core non-contact surface becomes. On the other hand, it is required for the gypsum core contact surface to maintain voids between the constituent fibers to a certain degree in order to increase the permeability of gypsum slurry. Thus, it is preferred that the amount of PVA fiber which so adheres to fill the voids between the constituent fibers is lower. Accordingly, by increasing the content ratio of PVA fibers in the external surface (the gypsum core non-contact surface) layer than that of the gypsum core contact surface layer, there can be obtained a non-woven fabric for a gypsum board which comprises a gypsum core non-contact surface suitably filling the voids between the fibers and having smoothness, and a gypsum core contact surface maintaining the voids between the fibers suitably and having a high permeability of the gypsum slurry. In the non-woven fabric for a gypsum board of the present invention, if the weight of PVA fiber per unit weight of the gypsum core contact surface is 1, the weight of PVA fiber per unit weight of the gypsum core non-contact surface is preferably more than 1 to 15 or less, more preferably 1.2 to 4.0.

In order to increase the strength of the non-woven fabric for a gypsum board of the present invention, or to control the permeability of gypsum, a synthetic resin type binder can be provided. The synthetic resin type binder may include, for example, latex such as acryl type, a vinyl acetate type, an epoxy type, a synthetic rubber type, an urethane type, a polyester type and vinylidene chloride type, polyvinyl alcohol and phenolic resin, etc. These binders can be used singly or in combination of two or more of them, and optionally, in combination with a linking agent and the like. The synthetic resin type binder is preferably provided in an amount of 1 to 60 parts by weight based on 100 parts by weight of the non-woven fabrics for a gypsum board (1) to (6) of the present invention, more preferably in an amount of 3 to 20 parts by weight.

To the non-woven fabric for a gypsum board of the present invention can be provided a water repellent agent for the purpose of preventing the dimensional change or strength reduction due to the moisture absorption of the gypsum board, and furthermore, for the purpose of improving the water resistance of the gypsum board for an interior material for water place such as a washstand and a bath room, or in the case that the gypsum board is exposed to rain and wind during the construction. As the water repellent agent related to the present invention, there may be used a conventionally known water repellent agent such as a silicon type and fluorine type. The water repellent agent is preferably provided in an amount of 0.1 to 5.0 part by weight based on 100 parts by weight of the non-woven fabrics for a gypsum board (1) to (6) of the present invention, more preferably in an amount of 0.2 to 3.0 parts by weight. Like the non-woven fabric for a gypsum board (9) of the present invention, both of the non-woven synthetic resin type binder and the water repellent agent may be provided to the non-woven fabric.

In the non-woven fabric for a gypsum board of the present invention, it is preferred that at least the gypsum core non-contact surface has the central surface average roughness SRa of 50 μm or less. The surface having the central surface average roughness SRa of 50 μm or less is smooth, so that when identification information including the logo of the manufacturing company and a trade name is printed, the printed information can be recognized clearly. Moreover, by providing an ink-receptive layer to the gypsum core non-contact surface of the non-woven fabric for a gypsum board of the present invention, printability can be improved and printing of more decorative pattern becomes possible. Thus, a gypsum board obtained by using the non-woven fabric for a gypsum board of the present invention becomes an interior gypsum board having higher decoration properties. The ink-receptive layer in the present invention comprises a composition comprising a pigment and a binder as main components. To the ink-receptive layer can be suitably formulated additives such as a dye-fixing agent, a pigment dispersing agent, a thickening agent, a flowability improving agent, an antifoamer, a foam-inhibitor, a mold lubricant, a foaming agent, a penetrating agent, a coloring dye, a coloring pigment, a fluorescent whitening agent, a UV absorber, an antioxidant, a preservative, a fungicide, a water resistant additive, a wet paper strength potentiator and a dried paper strength potentiator.

As a pigment to be used for the ink-receptive layer, one or more type of known white pigments can be used. As such a pigment, there may be used, for example, white inorganic pigments such as light calcium carbonate, heavy calcium carbonate, kaolin, talc, calcium sulfate, barium sulfate, titanium dioxide, zinc oxide, zinc sulfide, zinc carbonate, satin white, aluminum silicate, diatom earth, calcium silicate, magnesium silicate, synthetic amorphous silica, colloidal silica, colloidal alumina, pseudo boehmite, aluminum hydroxide, alumina, lithopone, zeolite, hydrous halloysite, magnesium carbonate and magnesium hydroxide, and organic pigments such as styrene type plastic pigments, acrylic type plastic pigments, polyethylene, microcapsule, urea resin and melamine resin.

Also, examples of the binder used for the ink-receptive layer include: polyvinyl alcohol, vinyl acetate, oxidized starch, etherified starch, cellulose derivatives such as carboxymethylcellulose and hydroxyethylcellulose, casein, gelatin, soy protein and silyl modified polyvinyl alcohol; maleic anhydride resin, conjugated diene type copolymer latex such as styrene-butadiene copolymer and methyl methacrylate-butadiene copolymer; acrylic type polymer latex such as polymer or copolymer of acrylic acid ester and methacrylic acid ester, and polymer or copolymer of acrylic acid and methacrylic acid; vinyl type polymer latex such as ethylene-vinyl acetate copolymer; or functional group modified polymer latex in which the above-mentioned various kinds of polymer is modified with functional group-containing monomer such as carboxyl group; an aqueous adhesive including thermoset synthetic resin type such as melamine resin and urea resin; synthetic resin type adhesive such as polymethylmethacrylate, polyurethane resin, unsaturated polyester resin, vinyl chloride-vinyl acetate copolymer, polyvinyl butyral and alkyd resin. One or more type of these binders can be used.

The ratio of the pigment and the binder in the ink-receptive layer is preferably 10 to 50 parts by weight of the binder based on 100 parts by weight of the pigment, more preferably in the range of 15 to 40 parts by weight of the binder. By coating a coating solution in which these pigments, a binder solution and other additives are mixed and drying the same, an ink-receptive layer can be prepared. The amount of the ink-receptive layer to be coated is preferably in the range of 3 to 50 $g/m^2$, more preferably 5 to 30 $g/m^2$ in dry weight. The ink-receptive layer can be coated onto the non-woven fabric by using various kinds of coating devices including a blade coater, a roll coater, an airknife coater, a bar coater, a rod blade coater, a short-dwell coater, a die coater, a comma coater, a reverse roll coater, a kiss coater, a dip coater, a curtain coater, an extrusion coater, a micro gravure coater and a size press.

To the non-woven fabric for a gypsum board of the present invention can be provided an adsorbing agent in order to provide a function of absorbing a gas such as harmful substances. The adsorbing agent related to the present invention is one having BET (Brunauer-Emmett-Teller) specific surface area of 1 $m^2/g$ or more, and may include iron type compounds such as iron oxide, zinc oxide, magnesium oxide, natural and synthetic zeolite, sepiolite, aluminum hydroxide, aluminum oxide, silica, silica-zinc oxide compound, silica-alumina-zinc oxide complex, complex phyllosilicate, activated charcoal, activated earth, or combination thereof. The BET specific surface area of these adsorbing agents is preferably 1 $m^2/g$ or more, more preferably 30 to 1500 $m^2/g$, further preferably 200 to 1500 $m^2/g$. When the value is less than 1 $m^2/g$, no sufficient absorbing effects can be obtained. When the value exceeds 1500 $m^2/g$, good absorbing effects can be obtained; however, such an adsorbing agent is expensive so that it is money-losing. As a method for providing an adsorbing agent, there may be mentioned a method of providing a coating solution containing these adsorbing agents, a binder solution such as polyvinyl alcohol, gelatin, starch and latex, a cross-linking agent, a water repellent agent or the like in admixture, or a method of providing the adsorbing agents by adding the same to fiber slurry, followed by treating with a cationizing agent to form a flock, and attaching the flock to the fiber during the papermaking step of the non-woven fabric. In the case where the adsorbing agent is provided by wet papermaking method, zeolite and silica-alumina-zinc oxide complex are preferred. Zolite is hydrous silicate represented by $mZnO_2n.sH_2O$, and natural one and synthetic one are present (W is Na, Ca, K, Ba and Sr, and Z is (Si+Al)). The particle size of zeolite is not particularly limited, and is preferably 0.01 to 500 μm, more preferably 0.05 to 100 μm.

As the adsorbing agent used for the non-woven fabric for a gypsum board of the present invention, of the above-mentioned substances, aluminum hydroxide, magnesium hydroxide and zeolite are particularly effective. Aluminum hydroxide and magnesium hydroxide also act as an inorganic fire retardant which exhibits fire retardant effects by drawing latent heat due to dehydration reaction at a high temperature to lower the ambient temperature. Also, there are some reports that the inorganic flame retardant as represented by aluminum hydroxide or magnesium hydroxide not only generates no harmful gas during the burning but also has a smoking inhibiting effect. Thus, by using aluminum hydroxide or magnesium hydroxide, not only odious smell or gas can be absorbed, but also fire retardant effects can be provided. Also, zeolite has fine pores so that the specific surface area thereof is high and it can provide higher absorbing ability even in small amounts. Moreover, zeolite also exhibits a dehumidification function, and absorbs moisture by incorporating the moisture into holes in the molecule. Therefore, zeolite can carry out the absorption and desorption of moisture quickly, and can absorb a large amount of moisture even under a low humidity condition. The amount of the adsorbing agent to be provided on the non-woven fabric is preferably in the range of 1 to 50 g/m$^2$, more preferably in the range of 5 to 30 g/m$^2$.

To the non-woven fabric for a gypsum board of the present invention can be provided titanium oxide for the purpose of degrading and removing odious smell or harmful chemical substances. Titanium oxide related to the present invention may include all the titanium oxide or titanium hydroxide referred to as hydrous titanium oxide, metatitanic acid, orthotitanic acid, titanium hydroxide in addition to conventionally used titanium oxide. As a method for preparing titanium oxide, there may be mentioned a method of hydrolyzing titanyl sulfate, titanium chloride, organic titanium compounds, etc. optionally in the presence of a nucleation seed (hydrolysis method), a method of adding an alkali agent to titanyl sulfate, titanium chloride, organic titanium compounds, etc. optionally in the presence of a nuclear seed to neutralize (neutralization method), and a method of burning the titanium oxide obtained by the hydrolysis method and the neutralization method (burning method) and the like. Any titanium oxide obtained by any preparation method can be used.

Titanium oxide is a semiconductor which initiates photocatalytic reaction and has a forbidden band width of about 3 eV. When titanium oxide is irradiated with light having an energy which corresponds to the forbidden band width, a free radical is generated at a surface of the titanium oxide. By irradiating the light at a time when harmful substances are adsorbed on a surface of titanium oxide, the generated free radical attacks the harmful substances and the harmful substances are generally oxidized. In this process, hydroxyl group present on the surface of titanium oxide acts as a generation point of the free radical, as described in "Titanium oxide" (attributed to Manabu Seino, GIHODO SHUPPAN Co., Ltd., 1991, pp. 175-176). Thus, titanium oxide is expected to have various kinds of properties such as light absorption and charge dissociation, as well as generation and regeneration of a free radical of hydroxyl group present at a surface of titanium oxide. For activating these processes sufficiently, it is effective to increase the surface area of the titanium oxide and increase the number of surface hydroxyl groups which act as a generation point of a free radical. Further, this is also preferred on the ground that as the surface area of the titanium oxide is increased, the area contacted with the harmful substances is increased and the efficiency of degrading and removing the harmful substances is improved. The specific surface area of titanium oxide is preferably 50 m$^2$/g or more, more preferably 100 m$^2$/g or more. Also, the particle size of the titanium oxide having such a specific surface area is preferably 30 nm or less, more preferably 10 nm or less. The state of the particle may be primary particle or aggregated particles, and such a particle state has no effect on the ability of degrading and removing the harmful substances. The amount of the titanium oxide to be provided on the non-woven fabric is preferably in the range of 1 to 100 g/m$^2$, more preferably 5 to 50 g/m$^2$.

An example of a method for providing titanium oxide to the non-woven fabric is as follows: in the case where the titanium oxide is added into the non-woven fabric such that the titanium oxide is dispersed in and carried by the non-woven fabric, the non-woven fabric containing titanium oxide can be prepared by, for example, adding titanium oxide into a fiber slurry and then conducting the papermaking during the manufacture of the non-woven fabric. At this time, it is preferred to use a cationic polymer aggregating agent such as cationic polyacrylic amide and poly(aluminum chloride), or an anionic polymer aggregating agent which forms a complex with the cationic polymer aggregating agent to strengthen their aggregation such as anionic polyacrylic amide, or anionic inorganic fine particles such as colloidal silica and bentonite, and to form aggregates of the titanium oxide. Alternatively, it is also possible to further increase the mechanical strength of the aggregates by containing fine fibers into the aggregates.

On the other hand, in the case where titanium oxide is coated onto the non-woven fabric such that the titanium oxide is dispersed in and carried by the non-woven fabric, by mixing the titanium oxide with an aqueous emulsion of a thermoplastic resin, etc. as an adhesive for fixing the titanium oxide to the non-woven fabric, wherein the each adhesive is used singly or optionally in combination with two or more of them, and by coating the mixture to the non-woven fabric using various kinds of coating devices such as a blade coater, a roll coater, an airknife coater, a bar coater, a rod blade coater, a short-dwell coater, a die coater, a comma coater, a reverse roll coater, a kiss coater, a dip coater, a curtain coater, an extrusion coater, a micro gravure coater, a size press and the like, the titanium oxide can be provided.

An aqueous emulsion of a thermoplastic resin means a thermoplastic polymer dispersed in water. The polymer components may include acrylic resin, styrene-acrylic copolymer, styrene-butadiene copolymer, ethylene-vinyl acetate copolymer, vinyl chloride-vinyl acetate copolymer, ethylene-vinyl acetate-vinyl chloride copolymer, polypropylene, polyester, phenoxy resin, phenolic resin, butyral resin and the like.

To the non-woven fabric for a gypsum board of the present invention can be provided a conductive composition for the purpose of shielding or absorption of electromagnetic wave. The conductive composition related to the present invention is not specifically limited so long as it exhibits conductivity, and the shape thereof may include fiber or particles. The conductive fiber used in the present invention may include, for example, metallic fibers such as copper, iron, aluminum and stainless, or carbon fibers. The conductive particles may include, for example, metallic particles such as gold, silver, copper, stainless, aluminum, zinc, tin, indium, antimony and nickel, conductive pigments such as carbon black and graphite, metal oxide such as zinc oxide, tin oxide and indium oxide, and the like. As a method for providing the conductive composition, there may be mentioned a method of mixing the conductive composition with a synthetic resin type binder such as an acrylic resin and coating the mixture onto the non-woven fabric which undergo papermaking using a coater, etc., or in the case where the non-woven fabric is prepared by the wet papermaking, a method of adding the composition to a fiber slurry and subjecting to papermaking, and the like.

The non-woven fabric for a gypsum board of the present invention is prepared by using a papermaking machine for producing a general paper or a wet non-woven fabric, for example, a horizontal type fourdrinier paper machine, a cylinder paper machine and an inclined wire type paper machine.

In the horizontal type fourdrinier paper machine, when a paper is prepared by using a wood pulp, the concentration of a slurry in which the wood pulp is dispersed is about 1%, and fibers tend to orient in the machine direction because the speed of the papermaking wire is conformed to the extrusion speed of the slurry, or is made to more rapid speed. On the other hand, a glass fiber has much longer fiber length and has less hydrophilicity as compared to the wood pulp, so that the dispersibility in water is worse. Also, the glass fiber is not fibrillated like wood pulp so that freeness is higher. Thus, when a non-woven fabric containing a glass fiber is prepared, it is required that the concentration of the slurry is less than 0.1%, and the speed of the papermaking wire is made to more rapid than the extrusion speed of the slurry so as not to impair the formation due to the extrusion flow of the slurry, as a result, fibers tend to further orient in the machine direction.

The cylindrical paper machine has a cylindrical system that backing wire and surface wire are stretched on a flame with holes or a honeycomb roll, wherein suction forming box is positioned inside a cylinder. In the cylindrical paper machine, the paper layer forming is generally carried out on ¼ of the cylinder surface, no means is present that promotes entanglement of fibers, and the slurry attached to the wire is fixed to the wire surface as being sucked in accordance with the cylinder rotation. Accordingly, the formed fiber web orients in the machine direction.

In the inclined wire type fourdrinier paper machine, as its name indicates, the wire in a forming zone is inclined at 10 to 25 degrees in upper angle toward the papermaking direction. As the configuration of the inclined wire type fourdrinier paper machine, it comprises a manifold which uniforms the flow in the width direction, a head box which adjusts the flow of paper material. Inside the head box, there is a stock deflector which converts the upward kinetic energy to a forming part. On the inclined wire, there is a bond regulator which controls the flow speed of the paper material and flows the paper material onto the forming box uniformly. Also, behind a breast roll, there are an apron board which uniformly flows the paper material supplied from the head box, and a forming box which sucks in the paper material and forms a paper layer. Moreover, behind a hinge roll, there is a suction board which controls the moisture of the wet paper. During the paper layer formation, the paper material flows with being dehydrated in such manner that the paper material is sandwiched between the inclined wire and the bond regulator on the forming box, and the fibers are also sucked in the right angle toward the wire, whereby the paper layer is formed. Thus, fibers can be orientated with higher amount in the width direction.

The non-woven fabric for a gypsum board of the present invention may be prepared by using singly a wet paper machine as mentioned above such as a horizontal type fourdrinier paper machine, a cylindrical paper machine and an inclined wire type fourdrinier paper machine, or may be prepared by laminating the non-woven fabric using a combination paper machine in which two or more machines which are the same kinds or the different kinds are set online. However, if a non-woven fabric in which fibers are oriented in one direction is used as a reinforcing material for a gypsum board, there is the a problem that the strength in the right angle direction toward the one direction is lowered. Thus, it is preferred to use an inclined wire type fourdrinier paper machine by which fibers are unlikely to orient in one direction. Also, in order to separate the respective functions of the non-woven fabric by making the fibrous constitution in the gypsum core contact surface of the non-woven fabric different from the fibrous constitution in the gypsum core non-contact surface of the same, it is preferred to use a combination paper machine in which two or more machines are set online.

The non-woven fabric for a gypsum board of the present invention is dried by attaching the same to Yankee dryer with pressure after the preparation of the fiber web as mentioned above. The Yankee dryer to be used in the present invention comprises a cylindrical dryer cell and a steam through the cell. In the Yankee dryer, drying is carried out by adjusting the temperature of the dryer surface to 100 to 160° C. and contacting the fiber web to the dryer surface. The dryer surface is subjected to sophisticated polishing processing. At the time that a fiber web in a wet paper state is contacted to the dryer surface, by attaching the fiber web to the dryer surface using a pressing roll called as touch roll, the surface of the non-woven fabric becomes smooth and glossy. In the non-woven fabric for a gypsum board of the present invention, at least the gypsum core non-contact surface (a surface corresponding to the exterior surface of the gypsum board) is made to a surface which is smooth and glossy in the manner as mentioned above, and optionally, by using two Yankee dryers, the both surfaces of the non-woven fabric may become smooth and glossy.

To the non-woven fabric obtained by the above-mentioned preparation method is optionally provided a water repellent agent and/or a synthetic resin type binder as mentioned above. As a method for providing the water repellent agent and/or the synthetic resin type binder, there may be a method of providing the same onto the entire non-woven fabric by way of the impregnation with a saturator or by way of the dipping immersion, or a method of providing the same onto one surface or both surfaces of the non-woven fabric by way of the coating with a gravure or wire bar, etc., or by way of the spray with a spray gun, and depending on its application, the providing method(s) can be suitably selected or used in combination. After providing the water repellent agent and/or the synthetic resin type binder, the non-woven fabric is dried by using an air dryer, a cylinder dryer, a suction drum type dryer, an infrared system dryer and the like.

Furthermore, to the non-woven fabric for a gypsum board of the present invention may be provided an ink-receptive composition in the case of increasing the decoration property and printability, an adsorbing agent in the case of providing the gas adsorptivity, titanium oxide in the case of providing a function of degrading or removing a gas, or a conductive composition in the case of providing a function of shielding or absorbing an electromagnetic wave, whereby functions may be added. In the case of providing an ink-receptive composition, it can be carried out by preparing a coating solution of an ink-receptive composition, and coating the coating solution to the gypsum core non-contact surface of the non-woven fabric for a gypsum board obtained by the preparation methods as mentioned above, by way of a gravure or wire bar, etc., to form an ink-receptive layer. Also, in the case of providing an adsorbing agent, titanium oxide or a conductive composition, in the same manner as in the ink-receptive composition, layers exhibiting the respective functions may be formed on the gypsum core non-contact surface of the non-woven fabric for a gypsum board which is prepared as mentioned above, or these substances may be provided to the entire non-woven fabric by way of the impregnation with a saturator or by way of the dipping immersion. Of course, the substances may be dispersed into the fiber slurry in combination with an aggregating agent and the like during the papermaking to be contained in the non-woven fabric. Also, the respective functions to be added to the non-woven fabric for a gypsum board can be combined depending on the application and in the range which does not inhibit the other functions. After providing the respective coating solutions to the non-woven fabric prepared by the wet papermaking, the non-woven fabric can be dried by using an air dryer, a cylinder dryer, a suction drum type dryer, an infrared system dryer and the like. However, in order to make the exterior surface of the gypsum board smooth, by attaching the non-woven fabric to Yankee dryer with pressure and drying the same, the smoothness of the dryer surface is transferred to the surface of the non-woven fabric and the smooth and uniform surface thereof can be formed.

In the following, the present invention will be specifically explained referring to Examples; however, the present invention is not limited to the Examples.

EXAMPLE

Example 1

A glass fiber (fiber diameter: 9 μm, fiber length: 13 mm, manufactured by ASAHI FIBER GLASS Co., Ltd., trade name: GLASSLON CHOPPED STRAND, Component: E glass), a polyester fiber (fineness: 0.6 dtex, fiber length: 5 mm, manufactured by TEIJIN FIBERS LTD., trade name: Teijin Tetoron), a polyester binder fiber (fineness: 1.1 dtex, fiber length: 5 mm, manufactured by UNITIKA. LTD., tradename: MELTY 4080), and PVA fiber (fineness: 1.1 dtex, fiber length: 3 mm, manufactured by KURARAY CO., LTD., trade name: VPB 107) were dispersed in water and mixed so as to have a fiber formulation of 20:50:20:10 in weight ratio in the mentioned order, to prepare an aqueous slurry having a concentration of 0.08%. A fiber web was prepared from the aqueous slurry by using an inclined wire type fourdrinier paper machine, and immediately after that, the fiber web was dried while attaching the same with pressure to the surface of Yankee dryer the surface temperature of which was 130° C. (hereinafter, the surface contacted with the Yankee dryer surface at this time is referred to as a yankee surface) to obtain a non-woven fabric for a gypsum board of Example 1 having a weight of 100.5 g/m$^2$ and a thickness of 398 μm.

Example 2

A glass fiber (fiber diameter: 9 μm, fiber length: 13 mm, manufactured by ASAHI FIBER GLASS Co., Ltd., trade name: GLASSLON CHOPPED STRAND, Component: E glass), a polyester fiber (fineness: 0.6 dtex, fiber length: 5 mm, manufactured by TEIJIN FIBERS LTD., trade name: Teijin Tetoron), a polyester binder fiber (fineness: 1.1 dtex, fiber length: 5 mm, manufactured by UNITIKA. LTD., trade name: MELTY 4080), and PVA fiber (fineness: 1.1 dtex, fiber length: 3 mm, manufactured by KURARAY CO., LTD., trade name: VPB 107) were dispersed in water and mixed so as to have a fiber formulation of 50:20:20:10 in weight ratio in the mentioned order, to prepare an aqueous slurry having a concentration of 0.08%. A fiber web was prepared from the aqueous slurry by using an inclined wire type fourdrinier paper machine, and immediately after that, the fiber web was dried while attaching the same with pressure to the surface of Yankee dryer the surface temperature of which was 130° C. to obtain a non-woven fabric for a gypsum board of Example 2 having a weight of 100.2 g/m$^2$ and a thickness of 401 μm.

Example 3

A glass fiber (fiber diameter: 9 μm, fiber length: 13 mm, manufactured by ASAHI FIBER GLASS Co., Ltd., trade name: GLASSLON CHOPPED STRAND, Component: E glass), a polyester fiber (fineness: 0.6 dtex, fiber length: 5 mm, manufactured by TEIJIN FIBERS LTD., trade name: Teijin Tetoron), a polyester binder fiber (fineness: 1.1 dtex, fiber length: 5 mm, manufactured by UNITIKA. LTD., trade name: MELTY 4080), and PVA fiber (fineness: 1.1 dtex, fiber length: 3 mm, manufactured by KURARAY CO., LTD., trade name: VPB 107) were dispersed in water and mixed so as to have a fiber formulation of 60:10:20:10 in weight ratio in the mentioned order, to prepare an aqueous slurry having a concentration of 0.08%. A fiber web was prepared from the aqueous slurry by using an inclined wire-type fourdrinier paper machine, and immediately after that, the fiber web was dried while attaching the same with pressure to the surface of Yankee dryer the surface temperature of which was 130° C. to obtain a non-woven fabric for a gypsum board of Example 3 having a weight of 100.6 g/m$^2$ and a thickness of 404 μm.

Example 4

A glass fiber (fiber diameter: 9 μm, fiber length: 13 mm, manufactured by ASAHI FIBER GLASS Co., Ltd., trade name: GLASSLON CHOPPED STRAND, Component: E glass), a polyester fiber (fineness: 0.6 dtex, fiber length: 5 mm, manufactured by TEIJIN FIBERS LTD., trade name: Teijin Tetoron), and PVA fiber (fineness: 1.1 dtex, fiber length: 3 mm, manufactured by KURARAY CO., LTD., trade name: VPB 107) were dispersed in water and mixed so as to have a fiber formulation of 50:40:10 in weight ratio in the mentioned order, to prepare an aqueous slurry having a concentration of 0.08%. A fiber web was prepared from the aqueous slurry by using an inclined wire type fourdrinier paper machine, and immediately after that, the fiber web was dried while attaching the same with pressure to the surface of Yankee dryer the surface temperature of which was 130° C. to obtain a non-woven fabric for a gypsum board of Example 4 having a weight of 100.3 g/m$^2$ and a thickness of 400 μm.

Example 5

A glass fiber (fiber diameter: 9 μm, fiber length: 13 mm, manufactured by ASAHI FIBER GLASS Co., Ltd., trade name: GLASSLON CHOPPED STRAND, Component: E glass), a polyester fiber (fineness: 0.6 dtex, fiber length: 5 mm, manufactured by TEIJIN FIBERS LTD., trade name: Teijin Tetoron), a polyester binder fiber (fineness: 1.1 dtex, fiber length: 5 mm, manufactured by UNITIKA. LTD., trade name: MELTY 4080), and PVA fiber (fineness: 1.1 dtex, fiber length: 3 mm, manufactured by KURARAY CO., LTD., trade name: VPB 107) were dispersed in water and mixed so as to have a fiber formulation of 40:10:40:10 in weight ratio in the mentioned order, to prepare an aqueous slurry having a concentration of 0.08%. A fiber web was prepared from the aqueous slurry by using an inclined wire type fourdrinier paper machine, and immediately after that, the fiber web was dried while attaching the same with pressure to the surface of Yankee dryer the surface temperature of which was 130° C. to obtain a non-woven fabric for a gypsum board of Example 5 having a weight of 100.4 g/m$^2$ and a thickness of 399 μm.

Example 6

A glass fiber (fiber diameter: 9 μm, fiber length: 13 mm, manufactured by ASAHI FIBER GLASS Co., Ltd., trade name: GLASSLON CHOPPED STRAND, Component: E glass), a polyester fiber (fineness: 0.6 dtex, fiber length: 5 mm, manufactured by TEIJIN FIBERS LTD., trade name: Teijin Tetoron), a polyester binder fiber (fineness: 1.1 dtex, fiber length: 5 mm, manufactured by UNITIKA. LTD., trade name: MELTY 4080), and PVA fiber (fineness: 1.1 dtex, fiber length: 3 mm, manufactured by KURARAY CO., LTD., trade name: VPB 107) were dispersed in water and mixed so as to have a fiber formulation of 60:20:10:10 in weight ratio in the mentioned order, to prepare a first layer aqueous slurry having a concentration of 0.08%. Next, a glass fiber (fiber diameter: 9 μm, fiber length: 13 mm, manufactured by ASAHI FIBER GLASS Co., Ltd., trade name: GLASSLON CHOPPED STRAND, Component: E glass), a polyester fiber (fineness: 1.45 dtex, fiber length: 5 mm, manufactured by KURARAY CO., LTD., trade name: KURARAY Ester), a polyester binder fiber (fineness: 2.2 dtex, fiber length: 5 mm, manufactured by UNITIKA. LTD., trade name: MELTY 4080), and PVA fiber (fineness: 1.1 dtex, fiber length: 3 mm, manufactured by KURARAY CO., LTD., trade name: VPB 107) were dispersed in water and mixed so as to have a fiber formulation of 40:30:20:10 in weight ratio in the mentioned order, to prepare a second layer aqueous slurry having a concentration of 0.08%. A first layer fiber web was prepared from the first layer aqueous slurry by using an inclined wire type fourdrinier paper machine so as to have a dried weight of 50 g/m$^2$. Then, to the first layer fiber web was laminated the second layer aqueous slurry by using a cylindrical paper machine such that the dried weight of the second layer alone was 50 g/m$^2$, to prepare a fiber web comprising two layers. Immediately after, the first layer surface of the fiber web was dried while attaching the same with pressure to the surface of Yankee dryer the surface temperature of which was 130° C. to obtain a non-woven fabric for a gypsum board of Example 6 having a weight of 100.7 g/m$^2$ and a thickness of 405 μm.

Example 7

A glass fiber (fiber diameter: 9 μm, fiber length: 13 mm, manufactured by ASAHI FIBER GLASS Co., Ltd., trade name: GLASSLON CHOPPED STRAND, Component: E glass), a polyester fiber (fineness: 0.6 dtex, fiber length: 5 mm, manufactured by TEIJIN FIBERS LTD., trade name: Teijin Tetoron), a polyester binder fiber (fineness: 1.1 dtex, fiber length: 5 mm, manufactured by UNITIKA. LTD., trade name: MELTY 4080), and PVA fiber (fineness: 1.1 dtex, fiber length: 3 mm, manufactured by KURARAY CO., LTD., trade name: VPB 107) were dispersed in water and mixed so as to have a fiber formulation of 40:20:10:30 in weight ratio in the mentioned order, to prepare a first layer aqueous slurry having a concentration of 0.08%. Next, a glass fiber (fiber diameter: 9 μm, fiber length: 13 mm, manufactured by ASAHI FIBER GLASS Co., Ltd., trade name: GLASSLON CHOPPED STRAND, Component: E glass), a polyester fiber (fineness: 1.45 dtex, fiber length: 5 mm, manufactured by KURARAY CO., LTD., trade name: KURARAY Ester), a polyester binder fiber (fineness: 2.2 dtex, fiber length: 5 mm, manufactured by UNITIKA. LTD., trade name: MELTY 4080), and PVA fiber (fineness: 1.1 dtex, fiber length: 3 mm, manufactured by KURARAY CO., LTD., trade name: VPB 107) were dispersed in water and mixed so as to have a fiber formulation of 40:30:20:10 in weight ratio in the mentioned order, to prepare a second layer aqueous slurry having a concentration of 0.08%. A first layer fiber web was prepared from the first layer aqueous slurry by using an inclined wire type fourdrinier paper machine so as to have a dried weight of 50 g/m$^2$. Then, to the first layer fiber web was laminated the second layer aqueous slurry by using a cylindrical paper machine such that the dried weight of the second layer alone was 50 g/m$^2$, to prepare a fiber web comprising two layers. Immediately after, the first layer surface of the fiber web was dried while attaching the same with pressure to the surface of Yankee dryer the surface temperature of which was 130° C. to obtain a non-woven fabric for a gypsum board of Example 7 having a weight of 100.6 g/m$^2$ and a thickness of 402 μm.

Example 8

A glass fiber (fiber diameter: 9 μm, fiber length: 13 mm, manufactured by ASAHI FIBER GLASS Co., Ltd., trade name: GLASSLON CHOPPED STRAND, Component: E glass), a polyester fiber (fineness: 0.6 dtex, fiber length: 5 mm, manufactured by TEIJIN FIBERS LTD., trade name: Teijin Tetoron), a polyester binder fiber (fineness: 1.1 dtex, fiber length: 5 mm, manufactured by UNITIKA. LTD., tradename: MELTY 4080), and PVA fiber (fineness: 1.1 dtex, fiber length: 3 mm, manufactured by KURARAY CO., LTD., trade name: VPB 107) were dispersed in water and mixed so as to have a fiber formulation of 50:20:20:10 in weight ratio in the mentioned order, to prepare an aqueous slurry having a concentration of 0.08%. A fiber web was prepared from the aqueous slurry by using an inclined wire type fourdrinier paper machine, and immediately after that, the fiber web was dried by using an air dryer at 130° C. to obtain a non-woven fabric for a gypsum board of Example 8 having a weight of 100.1 g/m$^2$ and a thickness of 410 μm.

Example 9

A glass fiber (fiber diameter: 9 μm, fiber length: 13 mm, manufactured by ASAHI FIBER GLASS Co., Ltd., trade name: GLASSLON CHOPPED STRAND, Component: E glass), a polyester fiber (fineness: 0.6 dtex, fiber length: 5 mm, manufactured by TEIJIN FIBERS LTD., trade name: Teijin Tetoron), a polyester binder fiber (fineness: 1.1 dtex, fiber length: 5 mm, manufactured by UNITIKA. LTD., trade name: MELTY 4080), and PVA fiber (fineness: 1.1 dtex, fiber length: 3 mm, manufactured by KURARAY CO., LTD., trade name: VPB 107) were dispersed in water and mixed so as to have a fiber formulation of 50:20:20:10 in weight ratio in the mentioned order, to prepare an aqueous slurry having a concentration of 0.08%. A fiber web was prepared from the aqueous slurry by using an inclined wire type fourdrinier paper machine, and immediately after that, the fiber web was dried while attaching the same with pressure to the surface of Yankee dryer the surface temperature of which was 130° C. to obtain a base fabric for a non-woven fabric. Then, an acrylic resin (Primal HA-16, manufactured by Nippon Acryl Chemical Co., Ltd.) was impregnated by using a saturator in an amount of 10 parts by weight based on 100 parts by weight of the base fabric. The yankee surface in the base fabric was dried while attaching the same with pressure to Yankee dryer the surface temperature of which was 130° C. to obtain a non-woven fabric for a gypsum board of Example 9 having a weight of 100.7 g/m$^2$ and a thickness of 402 μm.

Example 10

A glass fiber (fiber diameter: 9 μm, fiber length: 13 mm, manufactured by ASAHI FIBER GLASS Co., Ltd., trade name: GLASSLON CHOPPED STRAND, Component: E glass), a polyester fiber (fineness: 0.6 dtex, fiber length: 5 mm, manufactured by TEIJIN FIBERS LTD., trade name: Teijin Tetoron), a polyester binder fiber (fineness: 1.1 dtex, fiber length: 5 mm, manufactured by UNITIKA. LTD., tradename: MELTY 4080), and PVA fiber (fineness: 1.1 dtex, fiber length: 3 mm, manufactured by KURARAY CO., LTD., trade name: VPB 107) were dispersed in water and mixed so as to have a fiber formulation of 50:20:20:10 in weight ratio in the mentioned order, to prepare an aqueous slurry having a concentration of 0.08%. A fiber web was prepared from the aqueous slurry by using an inclined wire type fourdrinier paper machine, and immediately after that, the fiber web was dried while attaching the same to the surface of Yankee dryer the surface temperature of which was 130° C. with pressure to obtain a base fabric for a non-woven fabric. Then, a fluorine type water repellent agent (manufactured by ASAHI GLASS Co., Ltd., trade name: Asahi Guard) was coated to the yankee surface in the base fabric by using a gravure coater in an amount of 1 part by weight based on 100 parts by weight of the base fabric. The yankee surface of the base fabric was dried while attaching the same to Yankee dryer the surface temperature of which was 130° C. with pressure to obtain a non-woven fabric for a gypsum board of Example 10 having a weight of 100.3 g/m$^2$ and a thickness of 403 μm.

Example 11

A glass fiber (fiber diameter: 9 μm, fiber length: 13 mm, manufactured by ASAHI FIBER GLASS Co., Ltd., trade name: GLASSLON CHOPPED STRAND, Component: E glass), a polyester fiber (fineness: 0.6 dtex, fiber length: 5 mm, manufactured by TEIJIN FIBERS LTD., trade name: Teijin Tetoron), a polyester binder fiber (fineness: 1.1 dtex, fiber length: 5 mm, manufactured by UNITIKA. LTD., trade name: MELTY 4080), and PVA fiber (fineness: 1.1 dtex, fiber length: 3 mm, manufactured by KURARAY CO., LTD., trade name: VPB 107) were dispersed in water and mixed so as to have a fiber formulation of 50:20:20:10 in weight ratio in the mentioned order, to prepare an aqueous slurry having a concentration of 0.08%. A fiber web was prepared from the aqueous slurry by using an inclined wire type fourdrinier paper machine, and immediately after that, the fiber web was dried while attaching the same to the surface of Yankee dryer the surface temperature of which was 130° C. with pressure to obtain a base fabric for a non-woven fabric. Then, an acrylic resin (Primal HA-16, manufactured by Nippon Acryl Chemical Co., Ltd.) was impregnated by using a saturator in an amount of 10 parts by weight based on 100 parts by weight of the base fabric. Furthermore, a fluorine type water repellent agent (manufactured by ASAHI GLASS Co., Ltd., trade name: Asahi Guard) was coated to the yankee surface in the base fabric by using a gravure coater in an amount of 1 part by weight based on 100 parts by weight of the base fabric. The yankee surface in the base fabric was dried while attaching the same with pressure to Yankee dryer the surface temperature of which was 130° C. to obtain a non-woven fabric for a gypsum board of Example 11 having a weight of 100.5 g/m$^2$ and a thickness of 403 μm.

Comparative Example 1

A glass fiber (fiber diameter: 9 μm, fiber length: 13 mm, manufactured by ASAHI FIBER GLASS Co., Ltd., trade name: GLASSLON CHOPPED STRAND, Component: E glass) was dispersed in water and mixed to prepare an aqueous slurry having a concentration of 0.08%. A fiber web was prepared from the aqueous slurry by using an inclined wire type fourdrinier paper machine. Subsequently, an acrylic resin having a glass transition temperature of 60° C. (Primal HA-16, manufactured by Nippon Acryl Chemical Co., Ltd.) was provided by using a saturator in an amount of 10 parts by weight based on 100 parts by weight of the glass fiber. The material was dried by using an air dryer at 130° C. to obtain a non-woven fabric for a gypsum board of Comparative Example 1 having a weight of 100.1 g/m$^2$ and a thickness of 405 μm.

Comparative Example 2

A glass fiber (fiber diameter: 9 μm, fiber length: 13 mm, manufactured by ASAHI FIBER GLASS Co., Ltd., trade name: GLASSLON CHOPPED STRAND, Component: E glass), a polyester fiber (fineness: 0.6 dtex, fiber length: 5 mm, manufactured by TEIJIN FIBERS LTD., trade name: Teijin Tetoron), a polyester binder fiber (fineness: 1.1 dtex, fiber length: 5 mm, manufactured by UNITIKA. LTD., trade name: MELTY 4080), and PVA fiber (fineness: 1.1 dtex, fiber length: 3 mm, manufactured by KURARAY CO., LTD., trade name: VPB 107) were dispersed in water and mixed so as to have a fiber formulation of 10:60:20:10 in weight ratio in the mentioned order, to prepare an aqueous slurry having a concentration of 0.08%. A fiber web was prepared from the aqueous slurry by using an inclined wire type fourdrinier paper machine, and immediately after that, the fiber web was dried while attaching the same with pressure to the surface of Yankee dryer the surface temperature of which was 130° C. to obtain a non-woven fabric for a gypsum board of Comparative Example 2 having a weight of 100.0 g/m$^2$ and a thickness of 401 μm.

Comparative Example 3

A glass fiber (fiber diameter: 9 μm, fiber length: 13 mm, manufactured by ASAHI FIBER GLASS Co., Ltd., trade name: GLASSLON CHOPPED STRAND, Component: E glass), a polyester fiber (fineness: 0.6 dtex, fiber length: 5 mm, manufactured by TEIJIN FIBERS LTD., trade name: Teijin Tetoron), a polyester binder fiber (fineness: 1.1 dtex, fiber length: 5 mm, manufactured by UNITIKA. LTD., trade name: MELTY 4080), and PVA fiber (fineness: 1.1 dtex, fiber length: 3 mm, manufactured by KURARAY CO., LTD., trade name: VPB 107) were dispersed in water and mixed so as to have a fiber formulation of 70:5:15:10 in weight ratio in the mentioned order, to prepare an aqueous slurry having a concentration of 0.08%. A fiber web was prepared from the aqueous slurry by using an inclined wire type fourdrinier paper machine, and immediately after that, the fiber web was dried while attaching the same with pressure to the surface of Yankee dryer the surface temperature of which was 130° C. to obtain a non-woven fabric for a gypsum board of Comparative Example 3 having a weight of 100.2 g/m$^2$ and a thickness of 408 μm.

Comparative Example 4

A glass fiber (fiber diameter: 9 μm, fiber length: 13 mm, manufactured by ASAHI FIBER GLASS Co., Ltd., trade name: GLASSLON CHOPPED STRAND, Component: E glass), a polyester fiber (fineness: 0.6 dtex, fiber length: 5 mm, manufactured by TEIJIN FIBERS LTD., trade name: Teijin Tetoron), and PVA fiber (fineness: 1.1 dtex, fiber length: 3 mm, manufactured by KURARAY CO., LTD., trade name: VPB 107) were dispersed in water and mixed so as to have a fiber formulation of 50:45:5 in weight ratio in the mentioned order, to prepare an aqueous slurry having a concentration of 0.08%. A fiber web was prepared from the aqueous slurry by using an inclined wire type fourdrinier paper machine, and immediately after that, the fiber web was dried while attaching the same with pressure to the surface of Yankee dryer the surface temperature of which was 130° C. to obtain a non-woven fabric for a gypsum board of Comparative Example 4 having a weight of 100.4 g/m$^2$ and a thickness of 406 μm.

Comparative Example 5

A glass fiber (fiber diameter: 9 μm, fiber length: 13 mm, manufactured by ASAHI FIBER GLASS Co., Ltd., trade name: GLASSLON CHOPPED STRAND, Component: E glass), a polyester binder fiber (fineness: 1.1 dtex, fiber length: 5 mm, manufactured by UNITIKA LTD., trade name:

MELTY 4080), and PVA fiber (fineness: 1.1 dtex, fiber length: 3 mm, manufactured by KURARAY CO., LTD., trade name: VPB 107) were dispersed in water and mixed so as to have a fiber formulation of 40:30:30 in weight ratio in the mentioned order, to prepare an aqueous slurry having a concentration of 0.08%. A fiber web was prepared from the aqueous slurry by using an inclined wire type fourdrinier paper machine, and immediately after that, the fiber web was dried while attaching the same with pressure to the surface of Yankee dryer the surface temperature of which was 130° C. to obtain a non-woven-fabric for a gypsum board of Comparative Example 5 having a weight of 100.2 g/m$^2$ and a thickness of 395 μm.

Comparative Example 6

A conventional base paper for a gypsum board having a weight of 100 g/m$^2$ and a thickness of 280 μm, which is used for a gypsum board coated with a paperboard.

With respect to the non-woven fabrics for a gypsum board prepared by the above-mentioned Examples 1 to 11 and Comparative Examples 1 to 5, and to the base paper for a gypsum board of Comparative Example 6, the following evaluations were conducted. The results are shown in Table 1.

<Folding Endurance>

10 samples having a width of 15 mm and a length of 110 mm were cut from the non-woven fabrics for a gypsum board prepared according to the above-mentioned Examples 1 to 11 and Comparative Examples 1 to 5, and from the base paper for a gypsum board of Comparative Example 6, respectively. With respect to the each sample, the number of folding was measured by using MIT testing machine with a loading of 500 g in accordance with the manner specified in JIS P8115. The folding endurance was calculated from the obtained number of folding using the following equation 1. The respective average values of the 10 samples of the respective non-woven fabrics for a gypsum board and the base paper for a gypsum board were compared with each other.

$$FE=\log_{10}N$$

FE: Folding endurance

N: The number of folding

<Central Surface Average Roughness SRa>

As an index for surface smoothness of the non-woven fabric for a gypsum board and the base paper for a gypsum board, central surface average roughness SRa was measured by a feeler system three dimensional surface roughness measuring instrument. The central surface average roughness SRa was calculated using the following equation 2. Evaluations were conducted with respect to the surfaces corresponding to the exterior surfaces of gypsum boards prepared by using the non-woven fabrics for a gypsum board of Examples and Comparative Examples and the base paper for a gypsum board as mentioned below.

$$SRa = \frac{1}{Sa}\int_0^{Wx}\int_0^{Wy}|f(X, Y)|\,dX\,dY \tag{2}$$

In the equation 2, Wx represents a length in X axis direction of the sample surface area (papermaking direction), Wy represents a length in Y axis direction of the sample surface area (a direction at right angle to the papermaking direction), Sa represents an area of the sample surface area. Specifically, SRa can be obtained by using SE-3AK type instrument and SPA-11 type instrument manufactured by Kosaka Laboratory Ltd. as a feeler system three dimensional surface roughness measuring instrument and a three dimensional surface roughness analysis instrument, respectively, in a condition of Wx=50 mm, Wy=23.976 mm, accordingly of Sa=1198.8 mm$^2$, cut off=1.0 mm, X feeding speed=2 mm/sec. Sampling was conducted at 500 points for data processing in X axis direction and scanning was conducted in 25 lines in Y axis direction.

<Preparation of Gypsum Board>

Prepared were a non-woven fabric for a gypsum board or base paper for a gypsum board in which folding lines which specify the width and the thickness of the gypsum board were formed in two points of both ends in the width direction, and they were used as a reinforcing material for the under surface of the gypsum board. Then, a slurry in which calcined gypsum (manufactured by Fuji Sekko Co., Ltd.) was dispersed in a ratio of calcined gypsum:water=90:100 was cast onto the reinforcing material for the under surface, while the folding portions at the both ends of the reinforcing material on the under surface were folded at a predetermined angle for the forming in the width direction. Next, on the material were placed another non-woven fabric for a gypsum board or a base paper for a gypsum board as a reinforcing material on the upper surface, to form the gypsum board with the thickness of 12.5 mm. Subsequently, the material was dried by heat air dryer at 105° C. for an hour to obtain a gypsum board. At this time, the yankee surface of the non-woven fabrics for a gypsum board of Examples and Comparative Examples were placed so as to be the exterior surfaces of the gypsum boards (gypsum core non-contact surfaces).

<Peel Test of Reinforcing Material for Gypsum Board>

Samples with the width of 50 mm and the length of 120 mm were collected from the gypsum boards prepared according to the above-mentioned manner. The reinforcing material for a gypsum board on the upper surface was cut with a knife along the width direction so that a part of 20 mm from the tip edge (referred to as the terminal portion) was remained, and it was folded to the under surface side centering around the cut. Also, the portion opposite to the terminal portion was fixed so as to have 45° toward the normal line to the ground, and in this state, a 2 kg weight was hung on the tip of the terminal portion. The hand was released from the weight gently and it was observed whether the reinforcing material for a gypsum board on the under surface was peeled or not. Regarding the adhesiveness in the table, "○" represents that the reinforcing material for a gypsum board was hardly peeled and thus the adhesiveness was good, "Δ" represents a state that the reinforcing material for a gypsum board was peeled about 20 to 30%, and "X" represents that the reinforcing material for a gypsum board was peeled almost completely.

<Bending Test>

5 samples with the width of 300 mm and the length of 400 mm were collected from the respective gypsum boards prepared according to the above-mentioned manner, and a bending test was carried out according to the method specified in JIS A6901. The sample was supported at an interval of 350 mm in the length direction, and the loading speed was 250 N/min. The average values of the respective 5 samples obtained from the results were compared with each other.

<Total Water Absorption Test>

3 samples with the width of 300 mm and the length of 300 mm were collected from the respective gypsum boards prepared according to the above-mentioned manner, and total water absorption test was carried out according to the method specified in JIS A6901. The mass of the samples (m0) were measured when the samples were left standing in the condition at a temperature of 40±2° C. for 24 hours, and then, the samples were left standing in water at a temperature of 20±3° C. at a position of about 30 mm below water surface. After left standing for 2 hours, the samples were taken out from the water, the water adhered to each surface was wiped off, and the mass at the time of water absorption (m2) was measured. The total water absorption ratio was calculated using the following equation 3, and the average values of the respective 3 samples obtained from the results were compared with each other.

$$\text{Total water absorption ratio (\%)} = \frac{m2 - m0}{m0} \times 100 \quad (3)$$

TABLE 1

| | Folding endurance | Central surface average roughness μm | Peel test | Breaking load in bending N | Total water absorption ratio % |
|---|---|---|---|---|---|
| Example 1 | 2.87 | 28.4 | ○ | 506.4 | 8.8 |
| Example 2 | 2.38 | 29.1 | ○ | 548.7 | 8.9 |
| Example 3 | 1.24 | 30.2 | ○ | 572.3 | 8.9 |
| Example 4 | 2.42 | 40.5 | ○ | 567.2 | 8.7 |
| Example 5 | 2.51 | 18.4 | ○ | 532.9 | 9.0 |
| Example 6 | 2.45 | 32.3 | ○ | 557.6 | 8.6 |
| Example 7 | 2.72 | 15.4 | ○ | 553.4 | 8.9 |
| Example 8 | 2.25 | 48.2 | ○ | 524.3 | 8.8 |
| Example 9 | 2.41 | 28.3 | ○ | 607.4 | 8.3 |
| Example 10 | 2.35 | 28.7 | ○ | 546.0 | 7.2 |
| Example 11 | 2.43 | 28.2 | ○ | 606.8 | 7.0 |
| Comparative Example 1 | 0.30 | 75.7 | x | 609.1 | 8.8 |
| Comparative Example 2 | 3.05 | 28.0 | ○ | 453.2 | 8.6 |
| Comparative Example 3 | 0.82 | 35.3 | Δ | 591.5 | 9.0 |
| Comparative Example 4 | 0.96 | 61.3 | Δ | 497.3 | 8.5 |
| Comparative Example 5 | 1.54 | 12.9 | Δ | 484.8 | 10.2 |
| Comparative Example 6 | 2.23 | 25.6 | Δ | 532.9 | 21.1 |

As shown in Table 1, the non-woven fabrics for a gypsum board of Examples 1 to 11, which contain 20 to 60% by weight of the glass fiber, 10 to 50% by weight of the organic fiber and 10 to 50% by weight of the fibrous binder, have the folding endurance of 1.00 or more and the central surface average roughness of 50 μm or less, so that these non-woven fabrics have both the flexibility and the strength and surfaces thereof are smooth. When these non-woven fabrics are used for a reinforcing material for a gypsum board, the resulting gypsum board may become a gypsum board which is not only excellent in adhesiveness to the gypsum core or in mechanical strength such as bending strength but also is easy for the worker to handle during the manufacture or processing thereof because of its flexibility and less skin irritancy.

The non-woven fabrics for a gypsum board of Comparative Examples 1 and 3, in which the content of the glass fiber exceeds 60% by weight, have higher strength as used for the gypsum board. However, since the content of the organic fiber is less than 10% by weight, the folding endurance was less than 1.00, the flexibility was poor, cracks were generated during the manufacture of the gypsum board, and the spots from which gypsum leaks were found here and there. Also, the adhesiveness to the gypsum core was poor. Furthermore, Comparative Example 1 does not contain the fibrous binder, so that the central surface average roughness exceeds 50 μm, the skin irritancy due to the contained glass fiber was extremely high, so that it was difficult to handle. To the contrary, while the non-woven fabric for a gypsum board of Comparative Example 2, in which the content of the glass fiber is less than 10% by weight, has flexibility, the strength when used for the gypsum board was poor.

The non-woven fabrics for a gypsum board of Examples 1 to 7 and 9 to 11, which were obtained by preparing a fiber web by wet papermaking method, and immediately after that, drying the fiber web while attaching the same to Yankee dryer surface with pressure, had more smoother surface. The gypsum boards for which these non-woven fabrics were used as a reinforcing material have less skin irritancy and have surfaces with good decoration property. In the non-woven fabric for a gypsum board of Comparative Example 4, the content of the fibrous binder is less than 10% by weight, so that the central surface average roughness exceeds 50 μm, the surface property was poor, and some skin irritancy was felt during the handling. Also, the adhesiveness between the fibers which constitute the non-woven fabric was weak, so that the strength of the non-woven fabric itself was low, the folding endurance was 1.00 or less, and in the peel test for the reinforcing material for a gypsum board, the peeling was occurred inside the non-woven fabric, and the breaking strength in bending should a lower value. In the non-woven fabric for a gypsum board of Example 5, the content of the fibrous binder exceeds 50% by weight, so that the surface smoothness was excellent, but the fibrous binder, which was fused by heat during the drying in the papermaking, excessively filled voids between the constituent fibers of the non-woven fabric, the penetration of the gypsum slurry was bad during the manufacture of the gypsum board, and as a result, the adhesiveness to the gypsum core was poor and the breaking strength in bending was also poor.

The non-woven fabrics for a gypsum board of Examples 6 and 7, which comprise two layers, contain the polyester fiber and the polyester binder fiber with a thicker fiber diameter in the second layer (the layer on the gypsum core contact surface), so that as compared to the non-woven fabric for a gypsum board of Example 2 which comprises one layer and the formulation ratio of the fibers in the entire non-woven fabric is similar to those of Examples 6 and 7, the penetration of the gypsum slurry was good during the manufacture of the gypsum board, the adhesiveness of the non-woven fabric for a gypsum board to the gypsum core was increased, and as a result, the breaking strength in bending of the gypsum board was improved. Furthermore, in the non-woven fabric for a gypsum board of Example 7, the content of PVA fiber of the first layer (the layer on the gypsum core non-contact surface) was higher than that of the second layer, so that the smoothness of the gypsum core non-contact surface was improved.

In the non-woven fabric for a gypsum board of Example 9, in which the acrylic resin was impregnated after the drying in the papermaking, the strength was further improved. In the non-woven fabric for a gypsum board of Example 10, to which the water repellent agent was coated after the drying in the papermaking, the water resistance was increased. Moreover, in the non-woven fabric for a gypsum board of Example 11, to which the water repellent agent was coated after the impregnation of the acrylic resin, both of the strength and the water resistance were increased. The conventional base paper for a gypsum board of Comparative Example 6 has strength and smooth surface, but the water resistance was poor.

Example 12

To the gypsum core non-contact surface of the non-woven fabric for a gypsum board of Example 2 was coated a coating solution comprising 70 parts by weight of primary kaoline, 30 parts by weight of calcium bicarbonate, 8 parts by weight of SBR latex binder (Laxter DS-407, manufactured by DAINIPPON INK AND CHEMICALS, INCORPORATED), and 3 parts by weight of phosphoesterified starch (manufactured by Oji Cornstarch Co., Ltd.) by means of a blade coater so as to have the dried coating amount of 10 g/m$^2$. The material was pre-dried by an air through dryer, and then, the gypsum core non-contact surface was dried while attaching the same to Yankee dryer surface with pressure to obtain a non-woven fabric for a gypsum board of Example 12.

The following evaluations were carried out on the non-woven fabrics for a gypsum board of Examples 2 and 10 and Comparative Example 1, and the base paper for a gypsum board of Comparative Example 6. Results are shown in Table 2.

<Printing Density>

A black solid portion of "GEOS-G" manufactured by DAINIPPON INK AND CHEMICALS, INCORPORATED was printed by using "Dia Printer" manufactured by MITSUBISHI HEAVY INDUSTRIES, LTD., and printing density was measured by a Machbeth reflection densitometer RD-918 black filter. A three-grade evaluation was conducted. The printing density of 1.9 or more was marked as "○", 1.5 to 1.9 was marked as "Δ", and less than 1.5 was marked as "X". "○" represents that the printing density is extremely high and the material has a good printability. "Δ" represents that the printing density is slightly low but there is no problem in practice. "X" represents that the printability is poor.

<Preparation of Gypsum Board}

A gypsum board was prepared in the same manner as mentioned above.

<Bending Test>

Bending test was carried out in the same manner as mentioned above.

TABLE 2

| | Printing density | Breaking load in bending N |
|---|---|---|
| Example 2 | Δ | 548.7 |
| Example 12 | ○ | 547.9 |
| Comparative Example 1 | x | 609.1 |
| Comparative Example 6 | x | 532.9 |

As shown in Table 2, the gypsum boards in which the non-woven fabrics for a gypsum board of the present invention were used have higher strength and good surface printability. Moreover, by providing an ink-receptive layer, the printability is increased.

Example 13

To the gypsum core non-contact surface of the non-woven fabric for a gypsum board of Example 2 was coated a coating solution for an ink-receptive layer which comprises 100 parts by weight of synthetic amorphous silica (manufactured by Tokuyama Corporation, trade name: FINESIL X37B), 30 parts by weight of polyvinyl alcohol (manufactured by KURARAY CO., LTD., trade name: PVA 117), and 20 parts by weight of cationic dye fixing agent (manufactured by Sumitomo Chemical Co., Ltd., trade name: SUMIREZ RESIN 1001), by an air knife coater so as to have the dried coated amount of 10 g/m$^2$. The material was pre-dried by an air through dryer, and then, the gypsum core non-contact surface was dried while attaching the same to Yankee dryer surface with pressure to obtain a non-woven fabric for a gypsum board of Example 13.

The following evaluations were carried out on the non-woven fabrics for a gypsum board of Examples 2 and 13 and Comparative Example 1, and the base paper for a gypsum board of Comparative Example 6. The results are shown in Table 3.

<Printing Quality>

Printing was conducted by using an ink-jet printer PM-950 C manufactured by SEIKO EPSON CORPORATION. Uniformity of black solid portions, border of adjacent black solid portions and sharpness of outline characters on a colored background, and the like, were observed with naked eyes, and evaluated as printing quality. A three-grade evaluation was conducted. One whose printing quality is extremely poor was marked as "X", one whose level has no problem in practical use was marked as "Δ" and one whose level is excellent was marked as "○".

<Preparation of Gypsum Board>

A gypsum board was prepared in the same manner as mentioned above.

<Bending Test>

Bending test was carried out in the same manner as mentioned above.

TABLE 3

| | Printing quality | Breaking load in bending N |
|---|---|---|
| Example 2 | Δ | 548.7 |
| Example 13 | ○ | 547.2 |
| Comparative Example 1 | x | 609.1 |
| Comparative Example 6 | x | 532.9 |

As shown in Table 3, the gypsum boards in which the non-woven fabrics for a gypsum board of the present invention were used have high strength, have less bleeding of the ink even in the printing by ink-jet printing system, and have good legibility. Also, by providing an ink-receptive layer, the printing quality is furthermore improved.

Example 14

To the non-woven fabric for a gypsum board of Example 2 was impregnated an aqueous dispersion which comprises 100 parts by weight of aluminum hydroxide (manufactured by Sumitomo Chemical Co., Ltd.) and 50 parts by weight of acrylic resin type binder (Primal HA-16, manufactured by Nippon Acryl Chemical Co., Ltd.) by using a saturator so as to have the dried impregnated amount of 30 g/m$^2$. The material was pre-dried by an air through dryer, and then, the gypsum core non-contact surface was dried while attaching the same to Yankee dryer surface with pressure to obtain a non-woven fabric for a gypsum board of Example 14.

Example 15

To the non-woven fabric for a gypsum board of Example 2 was impregnated an aqueous dispersion which comprises 100 parts by weight of magnesium hydroxide and 50 parts by weight of acrylic resin type binder (Primal HA-16, manufactured by Nippon Acryl Chemical Co., Ltd.) by using a saturator so as to have the dried impregnated amount 30 g/m$^2$. The material was pre-dried by an air through dryer, and then, the gypsum core non-contact surface was dried while attaching the same to Yankee dryer surface with pressure to obtain a non-woven fabric for a gypsum board of Example 15.

Example 16

To the non-woven fabric for a gypsum board of Example 2 was impregnated an aqueous dispersion which comprises 100 parts by weight of zeolite and 50 parts by weight of acrylic resin type binder (Primal HA-16, manufactured by Nippon Acryl Chemical Co., Ltd.) by using a saturator so as to have the dried impregnated amount of 30 g/m$^2$. The material was pre-dried by an air through dryer, and then, the gypsum core non-contact surface was dried while attaching the same to Yankee dryer surface with pressure to obtain a non-woven fabric for a gypsum board of Example 16.

Example 17

To the non-woven fabric for a gypsum board of Example 2 was impregnated an aqueous dispersion which comprises 100 parts by weight of titanium oxide (manufactured by ISHIHARA SANGYO KAISHA, LTD.) and 50 parts by weight of acrylic resin type binder (Primal HA-16, manufactured by Nippon Acryl Chemical Co., Ltd.) by using a saturator so as to have the dried impregnated amount of 30 g/m$^2$. The material was pre-dried by an air through dryer, and then, the gypsum core non-contact surface was dried while attaching the same to Yankee dryer surface with pressure to obtain a non-woven fabric for a gypsum board of Example 17.

The following evaluations were conducted on the non-woven fabrics for a gypsum board of Examples 14 to 17 and Comparative Example 1, and the base paper for a gypsum board of Comparative Example 6. The results are shown in Table 4.

<Preparation of Gypsum Board>

A gypsum board was prepared in the same manner as mentioned above.

<Deodorizing Ability Test>

A sample with the size of 100 mm×100 mm was collected, and the sample was left standing on the bottom of a sealed container with the volume of 5.6 L equipped with 6 W black lump. To the container was filled 10 ppm of acetaldehyde, and after ten minutes, the concentration of acetaldehyde in the container was measured by gas chromatography. Evaluation was conducted according to the following criteria: "◎", the concentration of acetaldehyde is less than 2 ppm; "○", the same is 2 to 5 ppm; "Δ", the same is 5 to 7 ppm; and "X", the same exceeds 7 ppm.

<Degradation and Removal Ability Test>

After the above-mentioned deodorizing ability test, ultraviolet irradiation was conducted by using 6 W black lump from the point 2 cm above the sample, and the concentration of acetaldehyde was measured by using gas chromatography ten minutes after the ultraviolet irradiation. In the same manner as mentioned above, an evaluation was conducted according to the following criteria: "◎", the concentration of acetaldehyde is less than 2 ppm; "○", the same is 2 to 5 ppm; "Δ", the same is 5 to 7 ppm; and "X", the same exceeds 7 ppm.

<Bending Test>

Bending test was carried out in the same manner as mentioned above.

TABLE 4

| | Deodorizing ability | Degradation and removal ability | Breaking load in bending N |
|---|---|---|---|
| Example 14 | Δ | ○ | 594.8 |
| Example 15 | Δ | ○ | 596.9 |
| Example 16 | Δ | ○ | 595.2 |
| Example 17 | Δ | ◎ | 596.7 |
| Comparative Example 1 | x | x | 609.1 |
| Comparative Example 6 | x | x | 532.9 |

As shown in Table 4, the gypsum boards in which the non-woven fabrics for a gypsum board of the present invention were used had a high strength, and exhibited gas adsorptivity and the ability to degrade and remove gas.

Example 18

To the non-woven fabric for a gypsum board of Example 2 was impregnated an aqueous dispersion which comprises 100 parts by weight of carbon black and 50 parts by weight of acrylic resin type binder (Primal HA-16, manufactured by Nippon Acryl Chemical Co., Ltd.) by using a saturator so as to have the dried impregnated amount of 30 g/m$^2$. The material was pre-dried by an air through dryer, and then, the gypsum core non-contact surface was dried while attaching the same to Yankee dryer surface with pressure to obtain a non-woven fabric for a gypsum board of Example 18.

Example 19

A glass fiber (fiber diameter: 9 μm, fiber length: 13 mm, manufactured by ASAHI FIBER GLASS Co., Ltd., trade name: GLASSLON CHOPPED STRAND, Component: E glass), a polyester fiber (fineness: 0.6 dtex, fiber length: 5 mm, manufactured by TEIJIN FIBERS LTD., trade name: Teijin Tetoron), a polyester binder fiber (fineness: 1.1 dtex, fiber length: 5 mm, manufactured by UNITIKA. LTD., trade name: MELTY 4080), PVA fiber (fineness: 1.1 dtex, fiber length: 3 mm, manufactured by KURARAY CO., LTD., trade name: VPB 107), and polyacrylonitrile type carbon fiber (fineness: 3.3 dtex, fiber length: 5 mm, manufactured by MITSUBISHI RAYON CO., LTD., trade name: Pyrofil) were dispersed in water and mixed so as to have a fiber formulation of 38:16:16:15:15 in weight ratio in the mentioned order, to prepare an aqueous slurry having a concentration of 0.08%. A fiber web was prepared from the aqueous slurry by using an inclined wire type fourdrinier paper machine, and immediately after that, the fiber web was dried while attaching the same to the surface of Yankee dryer the surface temperature of which was 130° C. with pressure to obtain a non-woven fabric for a gypsum board of Example 19 having a weight of 130.4 g/m$^2$.

Example 20

To the non-woven fabric for a gypsum board of Example 2 was coated an aqueous dispersion which comprises 100 parts by weight of stainless fiber (fiber diameter: 10 μm, fiber length: 0.5 mm), 40 parts by weight of acrylic resin type binder (Primal HA-16, manufactured by Nippon Acryl Chemical Co., Ltd.) and 5 parts by weight of phosphoesterified starch (manufactured by Oji Cornstarch Co., Ltd., Ace P-616) by using an air knife coater so as to have the dried coated amount of 30 g/m$^2$. The material was pre-dried by using an air through dryer, and then, the gypsum core non-contact surface was dried while attaching the same to Yankee dryer surface with pressure to obtain a non-woven fabric for a gypsum board of Example 20.

Comparative Example 7

Polyacrylonitrile type carbon fiber (fineness: 3.3 dtex, fiber length: 5 mm, manufactured by MITSUBISHI RAYON CO., LTD., trade name: Pyrofil) was dispersed in water and mixed to prepare an aqueous slurry with a concentration of 0.08 W. A fiber web was prepared form the aqueous slurry by using an inclined wire type fourdrinier paper machine. Subsequently, to the fiber web was provided an acrylic resin type binder (Primal HA-16, manufactured by Nippon Acryl Chemical Co., Ltd.) in an amount of 10 parts by weight based on 100 parts by weight of the carbon fiber. The material was dried by using an air dryer at 130° C. to obtain a non-woven fabric for a gypsum board of Comparative Example 7 with a weight of 130.2 g/m$^2$.

The following evaluations were conducted on the non-woven fabrics for a gypsum board of Examples 18 to 20 and Comparative Examples 1 and 7. The results are shown in Table 5.

<Preparation of Gypsum Board>

A gypsum board was prepared in the same manner as mentioned above.

<Electromagnetic Wave Absorption Property>

A sample with the size of 150 mm×150 mm was collected, and the electromagnetic wave absorption amount was measured according to the reflected power test. Evaluation was conducted on the electromagnetic wave absorption amount at 60 GHx band, and it was evaluated as follows: "○", the absorption amount is 20 dB or more; "Δ", the same is 10 to 20 dB; and "X", the same is less than 10 dB.

<Bending Test>

Bending test was carried out in the same manner as mentioned above.

TABLE 5

| | Electromagnetic wave absorption property | Breaking strength in bending N |
|---|---|---|
| Example 18 | ○ | 595.4 |
| Example 19 | ○ | 594.3 |
| Example 20 | ○ | 596.9 |
| Comparative Example 1 | x | 609.1 |
| Comparative Example 7 | ○ | 327.2 |

As shown in Table 5, the gypsum boards in which the non-woven fabrics for a gypsum board were used had a high strength and exhibited a function of the electromagnetic wave absorption. The non-woven fabric of Comparative Example 7 has a good electromagnetic wave absorption property; however, it does not contain a glass fiber so that it is not suitable for a reinforcing material for a gypsum board.

Utilizability in Industry

The non-woven fabric for a gypsum board of the present invention can be used for building materials and the like effectively. The non-woven fabric for a gypsum board of the present invention is excellent in the mechanical strength, has flexibility, has uniformity and has a smooth surface. When this non-woven fabric is used for a gypsum board, compatibility with gypsum is good, and impregnation of gypsum is excellent. Thus, the gypsum board, in which the non-woven fabric for a gypsum board of the present invention is used, is excellent in the mechanical strength, has a good decoration property such as coating or wallpaper pasting, and has a good printability of identification information such as logo of manufactures and trade names. Moreover, the non-woven fabric of the present invention has flexibility and has a very little skin irritancy, so that the handling is easy during the manufacture and processing of the gypsum board, and the burden on the worker is reduced. In addition, to the non-woven fabric of the present invention can be added functions dependent on the applications, such as improvement of printability, adsorption of odor and poisonous gas, or degradation and removal of the gas, and electromagnetic wave absorption.

The invention claimed is:

1. A non-woven fabric for a gypsum board, the fabric comprising 20 to 60% by weight of a glass fiber, 10 to 50% by weight of an organic fiber and 10 to 50% by weight of a fibrous binder, which contains the organic fiber at least on a gypsum core contact surface of the fabric, wherein the fabric has a muitilayer structure and where at least part of the fibrous binder is a polyvinyl alcohol fiber, such that the weight of the polyvinyl alcohol fiber per unit weight of a gypsum core non-contact surface is more than 1 and is 15 or less if the weight of the polyvinyl alcohol fiber per unit weight of a gypsum core contact surface is defined as 1.

2. The non-woven fabric for a gypsum board according to claim 1, wherein the folding endurance specified in JIS P8115 is 1.00 or more.

3. The non-woven fabric for a gypsum board according to claim 1, wherein the organic fiber is a synthetic fiber.

4. The non-woven fabric for a gypsum board according to claim 1, which comprises a synthetic resin type binder provided in an amount of 1 to 60 parts by weight based on 100 parts by weight of the non-woven fabric.

5. The non-woven fabric for a gypsum board according to claim 1, which comprises a water repellent agent provided at least on a gypsum core non-contact surface of the non-woven fabric in an amount of 0.1 to 5.0 parts by weight based on 100 parts by weight of the non-woven fabric.

6. The non-woven fabric for a gypsum board according to claim 1, which comprises a synthetic resin type binder provided in an amount of 1 to 60 parts by weight and comprises a water repellent agent provided in an amount of 0.1 to 5.0 parts by weight, based on 100 parts by weight of the non-woven fabric.

7. The non-woven fabric for a gypsum board according to claim 1, which comprises an ink-receptive layer provided on a gypsum core non-contact surface of the non-woven fabric.

8. The non-woven fabric for a gypsum board according to claim 1, which comprises an adsorbing agent with BET specific surface area of 1 m$^{2/}$g or more provided on the non-woven fabric.

9. The non-woven fabric for a gypsum board according to claim 8, wherein the adsorbing agent is at least one selected from the group of aluminum hydroxide, magnesium hydroxide and zeolite.

10. The non-woven fabric for a gypsum board according to claim 1, which comprises titanium oxide provided on the non-woven fabric.

11. The non-woven fabric for a gypsum board according to claim 1, which comprises a conductive fiber or a conductive particle provided on the non-woven fabric.

12. The non-woven fabric for a gypsum board according to claim 11, wherein the conductive fiber is a metal fiber or a carbon fiber.

13. A process for producing a non-woven fabric for a gypsum board, the process comprising:

forming a fiber web comprising 20 to 60% by weight of a glass fiber, 10 to 50% by weight of an organic fiber and 10 to 50% by weight of a fibrous binder by a wet papermaking method, and then, drying the fiber web while attaching the same to a Yankee dryer with pressure; and wherein said forming includes forming the fabric with a multilayer structure; and distributing the fibrous binder through the fabric layers such that at least part of the fibrous binder is a polyvinyl alcohol fiber where the weight of the polyvinyl alcohol fiber per unit weight of a gypsum core non-contact surface is more than 1 and is 15 or less if the weight of the polyvinyl alcohol fiber per unit weight of a gypsum core contact surface is defined as 1.

14. The process for producing a non-woven fabric for a gypsum board according to claim 13, which comprises a step of providing a synthetic resin type binder to the non-woven fabric obtained by the wet papermaking method.

15. The process for producing a non-woven fabric for a gypsum board according to claim 13, which comprises a step of providing a water repellent agent to the non-woven fabric obtained by the wet papermaking method.

16. The process of claim 13, said forming further including forming the gypsum core non-contact surface such that it is ink-receptive.

17. The process of claim 13, said forming further including adding conductive fibers or conductive particles to the fiber web.

* * * * *